United States Patent [19]

Holce et al.

[11] 4,456,897

[45] * Jun. 26, 1984

[54] PLUNGER-OPERATED SWITCH UNIT

[75] Inventors: Thomas J. Holce, Portland; Charles M. Huckins, Tigard, both of Oreg.

[73] Assignee: Sentrol, Inc., Portland, Oreg.

[ * ] Notice: The portion of the term of this patent subsequent to Jun. 22, 1999 has been disclaimed.

[21] Appl. No.: 271,702

[22] Filed: Jun. 8, 1981

[51] Int. Cl.[3] ..... H01H 36/00

[52] U.S. Cl. ..... 335/205; 335/202

[58] Field of Search ..... 335/202, 205, 153; 174/52 R; 200/293, 294, 295; 339/128; 248/27

[56] References Cited

U.S. PATENT DOCUMENTS 4,336,518 6/1982 Holce et al. ..... 335/205

*Primary Examiner*—Harold Broome

*Attorney, Agent, or Firm*—Chernoff, Vilhauer, McClung, Birdwell & Stenzel

[57] ABSTRACT

A plunger-operated magnetically actuated switch enclosed in a generally cylindrical housing which may be mounted either within a cylindrical cavity or against a flat surface. A magnetic contact reed switch is housed alongside the guide for a plunger which carries a small permanent magnet. Depressing the plunger moves the magnet sufficiently to operate the magnetic reed switch. Optional plunger length and reed switch location provide for setting the switch in either a normally open or normally closed configuration. A flange is provided for securely mounting the switch unit in a cylindrical cavity. A resilient catch and a pair of mating hooks are provided to attach a flat mounting plate to the side of the housing and permit the switch unit to be mounted against a flat surface.

8 Claims, 6 Drawing Figures

PLUNGER-OPERATED SWITCH UNIT

BACKGROUND OF THE INVENTION

The present invention relates to a plunger-operated magnetically actuated reed switch, and particularly to a switch housing permitting mounting such a plunger-operated switch either within a cavity or against a flat surface.

Plunger-operated switches provide simplicity of installation and adjustment for many applications such as in security systems, for monitoring the position of doors and windows, and for controlling electrical circuits in response to the position of elements of industrial machinery.

Mechanically operated switches are subject to loss of reliabilty when used in industrial or outdoor environments where the air carries large amounts of dirt, salt, or oil which can foul the electrical contacts or cause bearings to seize. Magnetically actuated switches such as encapsulated magnetic contact reed switches, on the other hand, are not subject to environmental conditions of those types. Installation of a magnetic contact reed switch for actuation by a magnet carried on a door, window, or moving portion of an industrial machine, may, however, be difficult to accomplish satisfactorily. This may be the case where the switch must operate in response to a precise location of a moving object to meet the purpose at hand, or where there is insufficient space available for mounting a magnet on the moving object.

In some cases it is desirable to have a normally open circuit which closes in response to depression of a plunger, while in other situations the reverse is true.

In either security system or industrial applications, lack of available space, or a desire to protect or conceal a switch, may dictate mounting a switch unit within a cavity. In other situations, it may be required to mount a switch unit against a flat surface, in position to respond to motion of a movable portion of a mechanism in a direction parallel to the flat surface.

Yokoo U.S. Pat. No. 3,260,821 discloses a way of using a magnetic reed switch in a plunger-operated switch unit. Yokoo, however, discloses no particular structure or method for mounting such a switch.

Mayer U.S. Pat. No. 3,243,544 discloses another type of plunger-operated switch utilizing magnetic contact reed switches and movable magnets, but does not disclose a way to mount such a unit other than in a recessed location. The Mayer switch can be set for use in either a normally open or normally closed circuit. Both Yokoo and Mayer, however, require the use of magnets of particular shapes which are unnecessarily expensive to produce and are otherwise undesirably complex in construction.

A roller-operated magnetically actuated switch unit is disclosed in the pending U.S. patent application Ser. No. 207,263, filed Nov. 17, 1980, now U.S. Pat. No. 4,336,518 by Holce, et al. The plunger switch disclosed by Holce, et al. has no provision for alternative mounting locations, being adapted only for recessed mounting, although it can be used in either a normally open or normally closed circuit configuration.

What is desired, then, is a simply constructed plunger-operated magnetically actuated switch unit which can alternatively be operatively installed in an easily prepared cavity, or mounted against a flat surface. Preferably such a switch could be assembled using a single type of magnetic contact reed switch to provide a plunger-operated switch unit having either a normally open or normally closed configuration with the plunger released.

SUMMARY OF THE INVENTION

The aforementioned shortcomings and disadvantages of previously known plunger-operated switches are overcome by the present invention which provides an inexpensive plunger-operated magnetically actuated switch unit which may be mounted alternatively within a simply prepared cylindrical cavity or against a flat surface.

The plunger-operated switch unit of the present invention comprises a generally cylindrical molded plastic housing for containing both a magnetic contact reed switch and a plunger which carries a small permanent magnet closely adjacent to the reed switch itself. Movement of the magnet by depression or re-extension of the plunger is sufficient to operate the magnetic contact reed switch, either closing or opening the contacts, depending upon the manner in which the switch unit is initially set up. A cap for the housing includes a flange having screw holes to facilitate securely mounting the switch unit within a cylindrical hole of the proper size.

A mounting plate may be attached to the housing to permit mounting the switch unit against a flat surface. Both the housing and the mounting plate include hooks, which interlock to hold one end of the housing adjacent to the mounting plate. A resilient catch included on the mounting plate fits within a seat provided in the closed base of the housing to securely retain the other end of the housing against the mounting plate. Mounting screw slots provided in the mounting plate enable the switch unit to be mounted against any conveniently available flat surface.

It is therefore a primary objective of the present invention to provide an improved, simple, yet versatile plunger-operated magnetically actuated switch unit.

It is another important objective of the present invention to provide a novel plunger-operated switch unit which may be mounted either within an easily prepared cavity or on a convenient flat surface.

It is an important feature of the present invention that it provides a switch unit having a housing adapted for mounting within a cylindrical cavity, and a detachable mounting plate by which the switch unit may be securely attached to a flat surface.

It is another important feature of the present invention that it may be assembled to provide either a normally open circuit or a normally closed circuit, using a single type of magnetic reed switch.

It is an important advantage of the present invention that it provides a plunger-operated magnetically actuated switch unit which is more compact than has previously been available.

It is another important advantage of the present invention that it provides a plunger switch unit which is more versatile than those previously available.

DETAILED DESCRIPTION OF THE INVENTION

Figure 1:
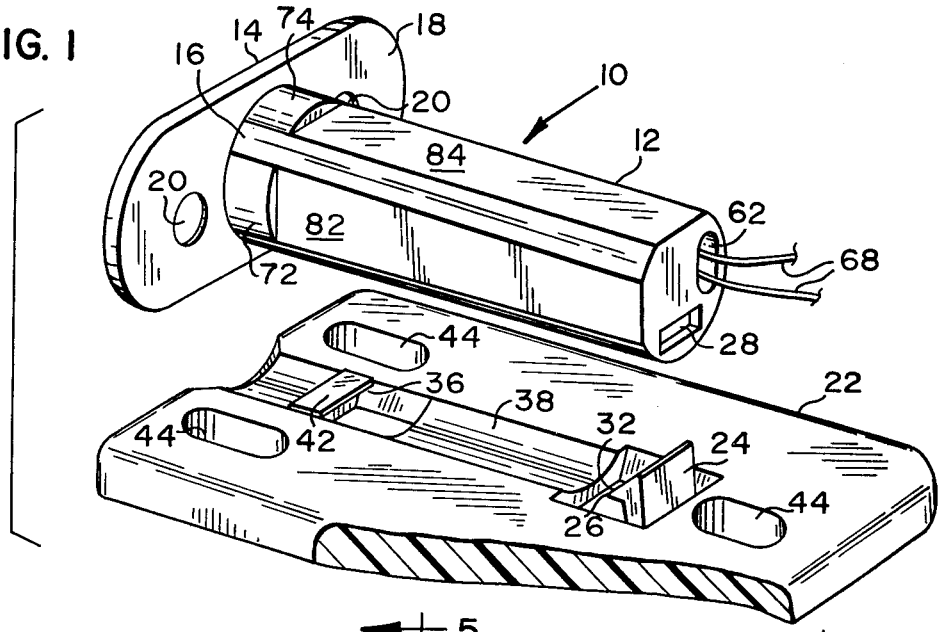
FIG. 1 is a partially cut away pictorial view of a plunger-operated switch unit which embodies the present invention.

Referring now to the drawings, an exemplary plunger-operated magnetically actuated switch unit designated generally by the numeral 10 is shown pictorially in FIG. 1. A generally cylindrial housing 12 has a cap 14 which closes an outer end 16 of the housing 12. The cap includes a radially extending flange 18 whose major plane is oriented generally perpendicular to the length of the housing 12. The flange 18 is provided with mounting screw holes 20, to retain the switch unit 10 securely with the flange 18 fastened to a flat surface and the switch housing 12 extending rearwardly from the surface, as within a hole bored through the surface to form a cavity. Extending parallel to the length of the housing 12, and thus perpendicular to the plane of the flange 18, is a detachable mounting plate 22 which may be latched to the housing 12.

The mounting plate 22 includes an upwardly extending resilient catch 24 having a jaw 26 directed forward, toward the outer end 16 of the housing 12. A recessed seat 28 for receiving the jaw 26 is provided in the base 30 of the housing 12. The catch 24 also includes a sloping top surface 32 which may be used to wedge the catch 24 rearwardly during installation of the mounting plate 22 on the housing 12.

Nearer to the outer end 16 of the housing 12, a pair of interlocking wedge-like hooks 34 and 36 are provided respectively on the housing 12 and the mounting plate 22. While hooks of other shapes might also serve, the wedge shape draws the housing 12 and mounting plate together in response to forward pressure exerted by the catch 24. The hook 34 extends toward the outer end 16 of the housing 12, while the hook 36 on the mounting plate 22 extends toward the jaw 26.

A round-bottomed depression or trough 38, whose shape corresponds to a part of the exterior of the housing 12, is provided in the surface of the mounting plate 22. The trough 38 receives the housing 12, cradling it to hold it in a fixed location.

Although the housing 12 is generally cylindrical, a flat surface 40 is provided between the hook 34 and the outer end 16 of the housing 12. A flat surface 42 is also provided on the top of the hook 36. The flat surfaces 40 and 42 cooperate matingly to prevent the housing 12 from rotating with respect to the mounting plate 22 when the mounting plate 22 is latched to the housing 12.

Elongated mounting screw holes 44 provided in the mounting plate 22 permit the switch unit 10 to be adjustably attached to a convenient surface.

Figure 3:
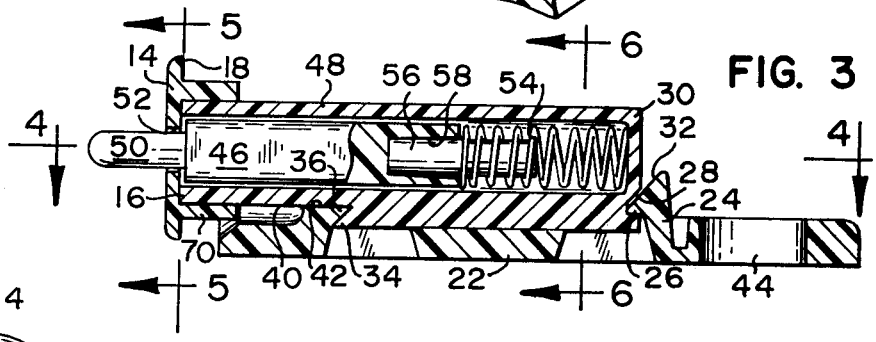
FIG. 3 is a sectional side elevational view, taken along line 3—3 of FIG. 2, of the plunger-operated switch unit shown in FIG. 1.
Figure 2:
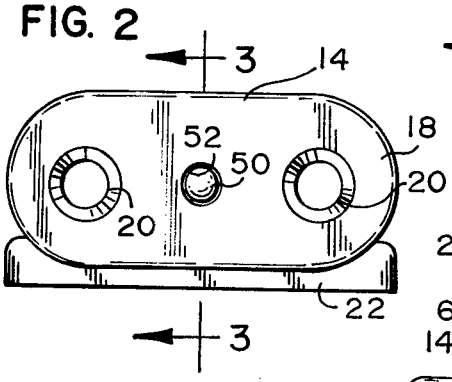
FIG. 2 is a front elevational view of the plunger-operated switch unit shown in FIG. 1.
Figure 4:
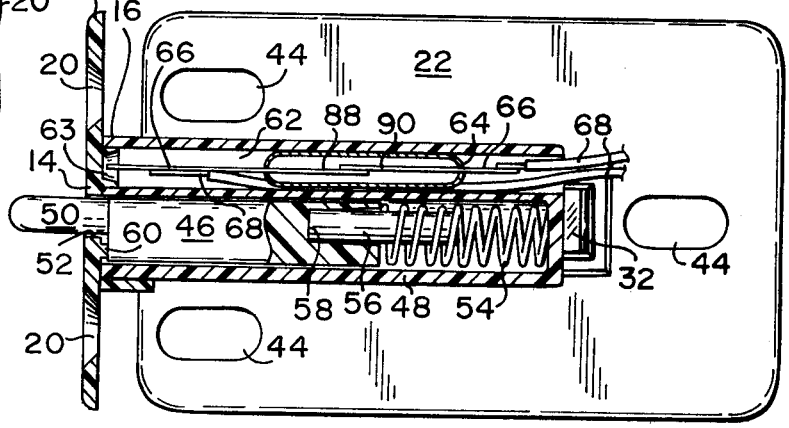
FIG. 4 is a sectional plan view, taken along line 4—4 of FIG. 3, of the plunger-operated switch unit shown in FIG. 1.

Referring now to FIGS. 2–4, it will be seen that the housing 12 contains a plunger 46 within a tubular plunger guide 48 which extends parallel to the length of the housing 12. The plunger 46 and the guide 48 preferably have a non-circular cross-sectional shape, as may be seen in FIG. 6, to prevent the plunger 46 from rotating in the guide 48. A stem 50 of the plunger protrudes through an aperture 52 in the cap 14, as the plunger 46 is urged outward by a helical spring 54 located within the plunger guide 48, between the plunger 46 and the closed base 30 of the housing 12. A small cylindrical stop 60 protrudes inwardly from the cap 14 to limit the protrusion of the stem 50. A small, longitudinally polarized, preferably cylindrical, permanent magnet 56 is held in a socket 58 defined in the inner end of the plunger 46, where the magnet 56 is held aligned with the length of the plunger guide 48 and is partially surrounded by the spring 54.

The housing 12, cap 16, and plunger 46 may be manufactured of a plastics material, preferably by injection molding. The cap 16 is preferably adhesively fastened in place on the outer end 14 of the housing 12, for example by the use of a solvent such as methyl ethyl ketone to soften the surfaces of the outer end 14. The stop 60 ensures that any adhesive material or softened material of the housing 12, extruded from the joint between the housing 12 and the cap 16 during assembly, does not alter the extended position of the plunger 46 within the plunger guide 48.

A tube 62 extends alongside and parallel to the plunger guide 48. The tube 62 is open through the base 30 of the housing 12, but an annular plug 63, a part of the cap 14, extends within the tube 62 at the outer end 16 of the housing 12.

A small elongate glass-encapsulated magnetic reed switch 64 is located within the tube 62 and may be potted in place. Its proper location may be established by trimming the length of the magnetic reed leads 66 and placing one of the magnetic reed leads 66 in contact with the interior of the cap 14. Proper trimming of the leads 66 also provides the proper total amount of magnetic material within the switch unit 10 so that the desired amount of movement of the plunger 46 will consistently cause operation of the reed switch 64. Wire leads 68 of non-magnetic material are soldered to the magnetic reed leads 66 of the magnetic reed switch 64 to provide interconnection with a security system circuit.

Figure 5:
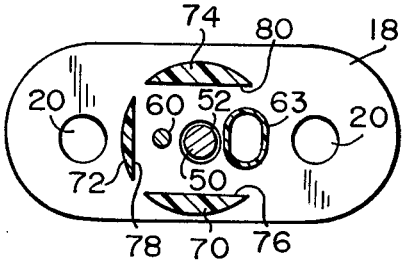
FIG. 5 is a sectional view, taken along line 5—5 of FIG. 3, of the plunger-operated switch unit shown in FIG. 1.
Figure 6:
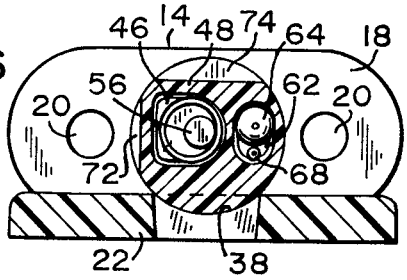
FIG. 6 is a sectional view, taken along line 6—6 of FIG. 3, of the plunger-operated switch unit shown in FIG. 1.

Referring now to FIGS. 5 and 6, it may be seen that the cap 14 has rearwardly directed protrusions 70, 72 and 74 having respective interior flat surfaces 76, 78 and 80 which fit matingly against corresponding flat surfaces 40, 82, and 84 of the housing 12. The exterior surfaces of the protrusions 70, 72, and 74 are, however, arcuate, complementing the cylindrical general shape of the housing 12 to form a cylindrical plug adjacent to the flange 18, so that the switch unit 10, without the mounting plate 22, may be mounted in a cylindrical hole drilled in a door frame or other convenient surface.

The switch unit may be assembled as shown in FIG. 4 with the overlapping contacts 88 and 90 of the magnetic reeds located adjacent to the midpoint of the length of the magnet when the plunger is extended, producing a normally closed circuit through the switch unit which opens when the plunger is depressed. It will be noted (FIG. 6) that the magnet 56 is carried in the plunger closely adjacent to the tube, separated from the contacts 88 and 90, for example, by less than 2.5 mm., to provide the proper magnetic fields for operating the magnetic reed switch 64.

Alternatively, the switch unit 10 may be assembled using a shorter plunger (not shown), holding the magnet 56 with one end adjacent to the overlapping contacts 88 and 90 of the magnetic reeds when the plunger is extended. In this mode of assembly, the magnetic contacts 88 and 90 remain separated when the plunger is extended. When the shorter plunger is depressed the mid portion of the magnet moves alongside the overlapping contacts 88 and 90 of the reeds, causing them to attract one another to close the electrical circuit through the switch unit. Thus the switch unit 10 may be assembled for either normally open or normally closed circuit use, depending upon the selection of plunger length and reed switch locations, as explained in greater detail in pending patent application Ser. No. 207,263, filed Nov. 17, 1980, now U.S. Pat. No. 4,336,518, of which the disclosure is hereby incorporated herein by reference.

Preferably a reed switch having a close operating differential, sometimes described as exhibiting a small amount of hysteresis, is preferable to provide a switch unit 10 which operates reliably at definite plunger positions and with an acceptably short plunger movement between the respective plunger positions at which the switch contacts close and open.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A plunger-operated magnetic contact switch unit, comprising:

(a) a switch housing including an elongate plunger guide and means for holding a magnetic contact reed switch alongside said plunger guide;

(b) a magnet-carrying plunger slidably disposed within said plunger guide;

(c) retaining means included as a part of said switch housing for retaining said switch housing in a predetermined position with said elongate plunger guide extending rearwardly from a surface to which said retaining means may be attached; and (d) mounting means detachably connectable with said switch housing, for mounting said switch unit on a surface with the length of said elongate plunger guide substantially parallel to said surface.

2. The switch unit of claim 1, said mounting means including a mounting plate and latch means for attaching said mounting plate to a side of said switch housing.

3. The switch unit of claim 2, said latch means including an inwardly facing catch and an opposed inwardly facing hook located on one of said housing and said mounting plate, and an outwardly facing catch seat and an opposed outwardly facing hook, both correspondingly located on the other one of said housing and said mounting plate.

4. The switch unit of claim 4 wherein said mounting plate includes a recessed area corresponding to the exterior shape of a part of said switch housing.

5. The switch unit of claim 4 wherein said switch housing and said mounting plate include mating flat surfaces, for holding said housing in a predetermined position and preventing rotation thereof with respect to said mounting plate.

6. The switch unit of claim 1 wherein said switch housing includes a cap defining an aperture and said plunger includes a stem extending through said aperture from within said plunger guide, said retaining means comprising a flange extending radially from said cap.

7. The switch unit of claim 2, wherein said latch means includes a resilient catch located on one of said mounting plate and said housing, and a corresponding seat defined in the other one of said mounting plate and said housing.

8. The switch unit of claim 8, wherein said resilient catch is located on said mounting plate and said seat is defined in said housing.

* * * * *

UNITED STATES PATENT AND TRADEMARK OFFICE

CERTIFICATE OF CORRECTION

PATENT NO. : 4,456,897

DATED : June 26, 1984

INVENTOR(S) : Thomas J. Holce and Charles M. Huckins

It is certified that error appears in the above-identified patent and that said Letters Patent are hereby corrected as shown below:

Col. 6, line 18, change "4" to read --3--.

Col. 6, line 21, change "4" to read --3--.

Col. 6, line 36, change "8" to read --7--.

Signed and Sealed this

*Eighteenth* Day of *June 1985*

[SEAL]

*Attest:*

DONALD J. QUIGG

*Attesting Officer* *Acting Commissioner of Patents and Trademarks*